US008425691B2

(12) United States Patent
Moyer

(10) Patent No.: US 8,425,691 B2
(45) Date of Patent: Apr. 23, 2013

(54) STAINLESS STEEL CARBURIZATION PROCESS

(76) Inventor: Kenneth H. Moyer, Cinnaminson, NJ (US)

( * ) Notice: Subject to any disclaimer, the term of this patent is extended or adjusted under 35 U.S.C. 154(b) by 0 days.

(21) Appl. No.: 12/971,068

(22) Filed: Dec. 17, 2010

(65) Prior Publication Data

US 2012/0018052 A1 Jan. 26, 2012

Related U.S. Application Data

(60) Provisional application No. 61/366,477, filed on Jul. 21, 2010.

(51) Int. Cl.
*C23C 8/22* (2006.01)

(52) U.S. Cl.
USPC ..... 148/223; 148/225; 148/319

(58) Field of Classification Search ..... 148/223, 148/225, 319
See application file for complete search history.

(56) References Cited

U.S. PATENT DOCUMENTS

| | | | | |
|---|---|---|---|---|
| 4,035,203 | A | 7/1977 | L'Hermite et al. | |
| 4,124,199 | A | 11/1978 | Jones et al. | |
| 4,853,046 | A * | 8/1989 | Verhoff et al. | 148/222 |
| 5,205,873 | A | 4/1993 | Faure et al. | |
| 5,424,028 | A * | 6/1995 | Maloney et al. | 420/38 |
| 5,702,540 | A | 12/1997 | Kubota | |
| 6,093,303 | A | 7/2000 | Williams et al. | |
| 6,287,393 | B1 | 9/2001 | Garg et al. | |
| 6,431,761 | B1 | 8/2002 | Yamaguchi et al. | |
| 6,451,137 | B1 | 9/2002 | Pelissier | |
| 6,461,448 | B1 | 10/2002 | Williams et al. | |
| 6,547,888 | B1 | 4/2003 | Williams et al. | |
| 6,846,366 | B2 | 1/2005 | Kawata et al. | |
| 6,991,687 | B2 | 1/2006 | Poor et al. | |
| 7,033,446 | B2 | 4/2006 | Poor et al. | |
| 7,186,304 | B2 | 3/2007 | Chin et al. | |
| 7,204,952 | B1 | 4/2007 | Poor et al. | |
| 7,217,327 | B2 | 5/2007 | Eiraku et al. | |
| 7,267,793 | B2 | 9/2007 | Poor et al. | |
| 7,326,306 | B2 | 2/2008 | Ishii et al. | |
| 7,431,778 | B2 | 10/2008 | Somers et al. | |
| 7,468,107 | B2 | 12/2008 | Tipps et al. | |
| 7,622,009 | B2 | 11/2009 | Kuwabara et al. | |
| 7,648,588 | B2 | 1/2010 | Hammond et al. | |
| 7,655,100 | B2 | 2/2010 | Kuwabara | |
| 7,794,551 | B1 | 9/2010 | Imbrogno et al. | |
| 7,811,390 | B2 | 10/2010 | Ishii et al. | |
| 7,887,747 | B2 | 2/2011 | Iwasaki et al. | |
| 2007/0044866 | A1 | 3/2007 | Morita et al. | |
| 2008/0006346 | A1 * | 1/2008 | Sato | 148/223 |

* cited by examiner

*Primary Examiner* — Jessee R. Roe
(74) *Attorney, Agent, or Firm* — Craig M. Bell

(57) ABSTRACT

The present invention is directed to a process for tempering steel comprising carburizing said steel in a vacuum furnace in the presence of a hydrocarbon carburizing gas in combination with hydrogen wherein said carburizing gas/hydrogen combination is administered to the vacuum furnace by cyclically reducing the pressure in the furnace followed by the pulsed addition of the hydrocarbon carburizing gas consisting of an acetylene/hydrogen mixture is in a ratio of from about 1:1 to about 1:10 to replenish the air removed in the pressure reduction step.

8 Claims, 11 Drawing Sheets

Carbon Content of Pyrowear 675 Carburized at 1000C in Acetylene at 8 Torr Pressure

*Microstructure of Pyrowear 675 Carburized*
for 9 Hours at 1000°C in Acetylene at 8 Torr Pressure Microstructure of Pyrowear 675 Carburized for 9 Hours
at 1000$^0$C in Acetylene at 8 Torr Pressure, Stabilized and Tempered at 510$^0$C Surface Etchant: Vilella's Reagent 50 Magnifications Surface Etchant: Vilella's Reagent 100 Magnifications

| Description | Initial Weight (g) | Final Weight (g) | Mass Loss (g) | Density ($g/cm^3$) | Volume Loss ($mm^3$) | Wheel Diameter Start | Wheel Diameter Finish | Loss (in) | AVL ($mm^3$) |
|---|---|---|---|---|---|---|---|---|---|
| 1010-9 T | 159.6974 | 159.2011 | 0.4963 | 7.68 | 64.62 | 8.759 | 8.758 | 0.001 | 66.41 |
| 1010-9 U | 159.2011 | 156.7675 | 2.4336 | 7.68 | 316.87 | 8.758 | 8.757 | 0.001 | 325.67 |

Table 1

Dry sand rubber wheel abrasion test ASTM G65 Procedure (A)

Wheel Durometer (Shore A) Bud Labs

| 1 | 2 | 3 | 4 |
|---|---|---|---|
| 60 | 60 | 61 | 59 |

Sand Flow Rate (Average)

340 g/m

Variation of Carbide Formers Within the Carburized Surface

Comparison of Carbon Pick-Up from Cycle 1 and Cycle 2

Comparison of Cycle 1 and Cycle 2 Surface Hardness of Pyroware 675

Surface

Etchant: Vilella's Reagent 50 Magnifications

Core

Etchant: Vilella's Reagent 100 Magnifications

STAINLESS STEEL CARBURIZATION PROCESS

CROSS-REFERENCE TO RELATED APPLICATIONS

This application claims the benefit of priority of U.S. Provisional Appln. No. 61/366,477 filed on Jul. 21, 2010.

This invention was made with United States government support under Naval Air (NAVAIR) Contract No. N68335-10-C-0173. The Government has certain rights in this invention.

FIELD OF THE INVENTION

The present invention relates generally to industrial coatings used in the protection of metal surfaces and methods for the application of said coatings onto said metal surface. More specifically, the present invention relates to the coating of iron-based and stainless steel surfaces for the protection thereof against the weather and other external environmental elements.

BACKGROUND OF THE INVENTION

Modern jet aircraft, particularly those employed in the Navy require improved tail hook material in order to arrest the craft during carrier and field carrier landing practice. In arresting the craft, friction and thermal loading results from engagement and as the tail hook engages and slides when mating the arresting cable. Current materials and protective surfaces are not easily manufactured and associated processing is time consuming and costly. Therefore, there have been attempts to develop new innovative alloys and processes that will be more cost and energy effective while improving performance in arresting modern aircraft. Of particular interest are the wear and corrosion resistance of surfaces that mate and slide while the arresting gear tail hook engages and arrests the aircraft. It would be beneficial then to develop a material and processing that would not require external processing to protect or minimize the engaging surface against wear and corrosion. The characteristics of the alloy should also satisfy internal properties required and characteristic of a stainless steel alloys.

One goal of the present invention is to develop a process for an improved performance steel using high temperature carburizing (nitriding) for improved wear resistance with improved corrosion resistance in respect to stainless steel alloys without compromising internal base properties of the steel. To this end, a primary objective was to develop a carburization process that would provide a hard, wear resistant surface that would in addition provide the corrosion resistance of a martensitic stainless steel. This is accomplished by using the inherent protection of the chromium to enhance the wear resistance by formation of protective carbides, in addition to the properties afforded by martensitic formation of the base surface without sacrifice of the corrosion resistance provided by the chromium addition to the martensitic stainless steel.

Stainless steels may be classified by their crystalline structure into three main types: Austenitic, Ferritic and Martensitic. Martensitic steels are low carbon steels comprising a composition of iron, 12% chromium, and 0.12% carbon. They may be tempered and hardened. Martensitic steel possesses great hardness, but has reduced toughness and is brittle, so few steels are fully hardened. Martensitic steel is formed by the rapid cooling (quenching) of austenite which traps carbon atoms that do not have time to diffuse out of the crystal structure. This martensitic reaction begins during cooling when the austenite reaches the martensitic steel start temperature (Ms) and the parent austenite becomes mechanically unstable. At a constant temperature below Ms, a fraction of the parent austenite transforms rapidly, and then no further transformation will occur. When the temperature is decreased, more of the austenite transforms to martensite. Finally, when the martensite finish temperature (Mt) is reached, the transformation is complete. Martensite can also form by application of stress (this property is frequently used in toughened ceramics like yttrium-stabilized zirconium and in special steels like TRIP steels (i.e. transformation induced plasticity steels)). Thus, martensite can be thermally—induced or stress—induced.

Austenite (or gamma phase iron) is a metallic, non-magnetic allotrope of iron or a solid solution of iron, with an alloying element, such as ferric carbide or carbon in iron, used in making corrosion-resistant steel. In plain-carbon steel, austenite exists above the critical eutectoid temperature of 1,000° K (730° C.); other alloys of steel have different eutectoid temperatures. Its face-centered cubic (FCC) structure allows it to hold a high proportion of carbon in solution. As it cools, this structure either breaks down into a mixture of ferrite and cementite (usually in the structural forms pearlite or bainite), or undergoes a slight lattice distortion known as martensitic transformation. The rate of cooling determines the relative proportions of these materials and therefore the mechanical properties (e.g. hardness, tensile strength) of the steel. Quenching (to induce martensitic transformation), followed by tempering (to break down some martensite and retained austenite), is the most common heat treatment for high-performance steels. The addition of certain other metals, such as manganese and nickel, can stabilize the austenitic structure, facilitating heat-treatment of low-alloy steels. In the extreme case of austenitic stainless steel, much higher alloy content makes this structure stable even at room temperature. On the other hand, such elements as silicon, molybdenum, and chromium tend to de-stabilize austenite, raising the eutectoid temperature (the temperature where two phases, ferrite and cementite, become a single phase, austenite).

Austenite can contain far more carbon than ferrite, between 0.8% at 1333° F. (723° C.) and 2.08% at 2098° F. (1148° C.). Thus, above the critical temperature, all of the carbon contained in ferrite and cementite (for a steel of 0.8% C) is dissolved in the austenite.

One of the differences between the two phases is that martensite has a body centered tetragonal crystal structure, whereas austenite has a face center cubic (FCC) structure. The transition between these two structures requires very little thermal activation energy because it is a martensitic transformation, which results in the subtle but rapid rearrangement of atomic positions, and has been known to occur even at cryogenic temperatures. Martensite has a lower density than austenite, so that the martensitic transformation results in a relative change of volume.

Carburization is the introduction of additional carbon to the surface of a steel part in order to effect case hardening. In gaseous carburizing, an endothermic gas, which contains carbon monoxide and hydrogen, is used as a carrier gas to displace the air in the furnace. A hydrocarbon-containing gas such as natural gas, propane or butane is added to the endothermic gas in varying quantities. The carbon monoxide from the endothermic gas and the hydrocarbon react to form nascent carbon atoms, which in turn combine with the iron in the steel to form iron carbide. The iron carbide provides the case.

The steel is exposed to the carburizing atmosphere at high temperatures, e.g. temperatures in the austenitic range for the steel in question, for a predetermined time to achieve the desired depth of carbon penetration into the steel surface. This depth is called the depth of the case. Carburized or case hardened steel has many important uses because of its desirable properties. The case provides extreme hardness at the surface while the inner portion, or core, beyond the case is relatively soft and ductile. Therefore, case hardened steel has excellent wear properties in combination with the toughness of the core.

In conventional gas carburizing furnaces, a carburizing atmosphere is force circulated by a fan system over the steel in the chamber at atmospheric pressures. Usually, a hydrocarbon gas, such as is found in natural gas, is utilized in combination with a carrier gas, such as an endothermic gas, as the carburizing atmosphere. The carburizing atmosphere is circulated in the furnace for a predetermined time and under predetermined conditions to carburize the steel. The various ramifications and modifications of this technique are well known to those skilled in the art.

Carburization of steel involves a heat treatment of the metallic surface using a gaseous, liquid, solid or plasma source of carbon. Early carburization techniques used a direct application of charcoal packed onto the metal (initially referred to as case hardening or Kolsterizing), but modern techniques apply carbon-bearing gases or plasmas (such as carbon dioxide or methane). The process depends primarily upon ambient gas composition and furnace temperature, which must be carefully controlled, as the heat may also impact the microstructure of the rest of the material. For applications where great control over gas composition is desired, carburization may take place under very low pressures in a vacuum chamber.

Plasma carburization is increasingly used in major industrial regimes to improve the surface characteristics (such as wear and corrosion resistance, hardness and load bearing capacity, in addition to quality-based variables) of various metals, notably stainless steels. The process is used as it is environmentally friendly (in comparison to gaseous or solid carburization). It also provides an even treatment of components with complex geometry (the plasma can penetrate into holes and tight gaps), making it very flexible in terms of component treatment.

The process of carburization works via the implantation of carbon atoms into the surface layers of a metal. As metals are made up of atoms bound tightly into a metallic crystalline lattice, the implanted carbon atoms force their way into the crystal structure of the metal and either remain in solution (dissolved within the metal crystalline matrix (this normally occurs at lower temperatures) or react with the host metal to form ceramic carbides (normally at higher temperatures, due to the higher mobility of the host metals' atoms). Both of these mechanisms' strengthen the surface of the metal, the former by causing lattice strains by virtue of the atoms being forced between those of the host metal and the latter via the formation of very hard particles that resist abrasion. However, each different hardening mechanism leads to different solutions to the initial problem. The former mechanism, known as solid solution strengthening, improves the host metals' resistance to corrosion while increasing the alloys hardness. The latter, known as precipitation strengthening, greatly improves the hardness of the alloy but normally to the detriment of the host metals' corrosion resistance. Engineers using plasma carburization must decide which of the two mechanisms matches their needs.

There are different types of elements or materials that can be used to perform this process, but these mainly consist of high carbon content material. A few typical hardening agents include carbon monoxide gas (CO), sodium cyanide (NaCN) and barium chloride ($BaCl_2$), or hardwood charcoal. In gas carburizing, the CO is derived from a propane or natural gas source. In liquid carburizing, the CO is derived from a molten salt composed mainly of sodium cyanide and barium chloride. In pack carburization, the carbon monoxide source comes from coke or hardwood charcoal.

In oxy-acetylene welding, a carburizing flame is one with little oxygen, which produces a sooty, lower-temperature flame. It is often used to anneal metal, making it more malleable and flexible during the welding process. A main goal when producing carbonized work pieces is to insure maximum contact between the work piece surface and the carbon-rich elements. In gas and liquid carburizing, the work piece is often supported in mesh baskets or suspended by wire.

In pack carburizing, the work piece and carbon are enclosed in a container to ensure that contact is maintained over as much surface area as possible. Pack carburizing containers are usually made of carbon steel coated with aluminum or heat-resisting nickel/chromium alloy and sealed at all openings with fire clay. In gas nitriding the donor is a nitrogen rich gas usually ammonia ($NH_3$), which is why it is sometimes known as ammonia nitriding. When ammonia comes into contact with the heated work piece it disassociates into nitrogen and hydrogen. The nitrogen then diffuses from the surface into the core of the material. This process has been around for nearly a century though only in the last few decades has there been a concentrated effort to investigate the thermodynamics and kinetics involved.

U.S. Pat. No. 4,386,973 to Herring et. al. discloses and claims a process for carburizing steel comprising carburizing said steel under vacuum in a vacuum furnace in the presence of a hydrocarbon carburizing agent while utilizing as a carrier gas an aliphatic alcohol having 1 to 4 carbon atoms. The carburizing agent is supplied during said carburizing by cyclically reducing the pressure in the furnace followed by the addition of hydrocarbon carburizing agent to the furnace to replenish gas removed in the pressure reduction step.

The carburization process per se then, is not new technology. The standard process simply introduces carbon to the surface of a steel and relies on diffusion to transport the carbon internally from the surface into the interior. There are many methods developed to accomplish this using solid state carburization, such as pack carburization, traditional gas carburization and more recently, partial pressure gas carburization in vacuum furnaces. The later process has recently been successful in the carburization of traditional low alloy and tool steels. However, owing to the problem of grain growth, the carburization temperature is usually limited to the range of 845° C. to 950° C. This requires long periods of time in order to permit sufficient diffusion to occur so as to obtain the required depth of carburization to protect against wear.

SUMMARY OF THE INVENTION

The present invention comprises the carburization of steel with a gaseous carbon compound wherein the reaction pressure is lowered. This is defined as high temperature partial pressure gas carburization, which is different than the process briefly described above. It is an improvement over the processes known in the prior art since the process of the present invention can use any carbonaceous compound in any gaseous transport medium. This can then be carried out at higher temperatures to deposit the nano-size carbon particles upon an activated surface at higher temperatures to activate the deposition and the diffusion thereof. This results in significantly shorter cycles for deposition and diffusion for a required depth of carburization.

DETAILED DESCRIPTION OF THE INVENTION

Figure 1:
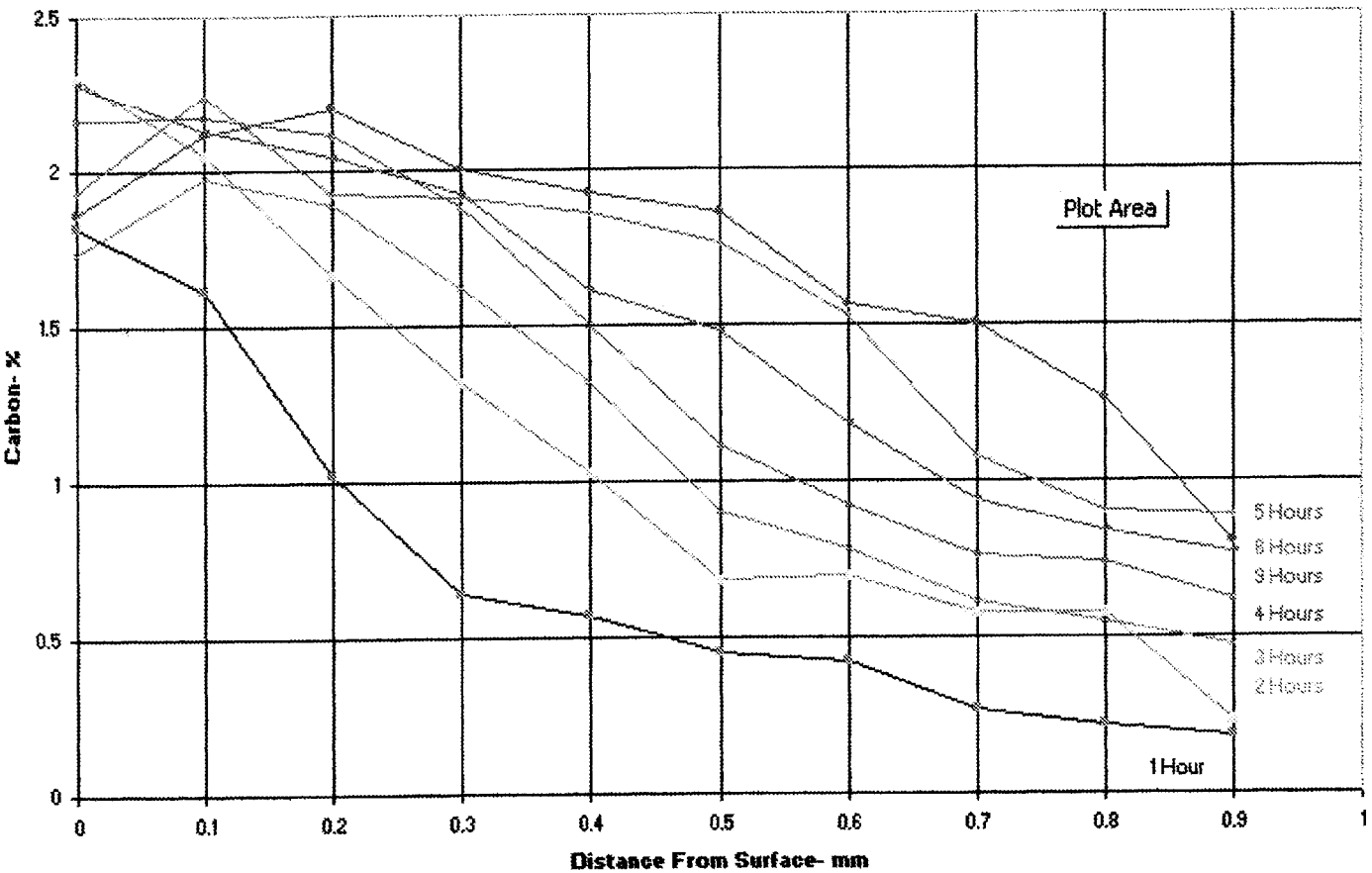
FIG. 1 shows a number of different carbon content profiles of steel carburized for different time periods.

The present invention is derived around a concept of carburizing a stainless steel alloy in a gaseous carbon compound at partial pressure, which is herein defined as high temperature partial pressure gas carburization. This is different than the process described above. It is different because the process of the present invention can use any carbonaceous compound in any gaseous transport medium to deposit the nano-size carbon upon an activated surface at higher temperatures which enables the deposition and the diffusion thereof resulting in significantly shorter cycles for deposition and diffusion for a required depth of carburization.

The present invention comprises a process for hardening steel comprising carburizing said steel in a vacuum furnace in the presence of a hydrocarbon carburizing gas in combination with hydrogen. The carburizing gas/hydrogen combination is administered to the vacuum furnace by cyclically reducing the pressure in the furnace followed by the pulsed addition of the hydrocarbon carburizing gas to replenish the air removed in the pressure reduction step.

More specifically, the process comprises the steps of:

(a) reducing the atmospheric pressure of the furnace by removing the air there from;

(b) raising the temperature within the furnace in order to further remove any remaining oxygen or air from the surface of the steel;

(c) injecting the carburizing gas/hydrogen combination into the furnace; and (d) then rapidly quenching the steel at increased pressure to produce a martinsitic base.

The hydrocarbon carburizing gas is selected from the group consisting of acetylene and methane and is preferably acetylene. The acetylene/hydrogen mixture is hydrocarbon/carburizing gas is injected into said furnace through a pulsed injection in a ratio of from about 1:1 to about 1:10, and preferably the mixture is in a ratio of from about 1:9. The temperature within the furnace is raised to from about 900° F. to about 2500° F. while the gas is introduced through pulsed injection into a furnace atmospheric pressure of from about 300 torr to about 500 torr.

Preferably, the steel is carburized at a temperature of from about 1400° F. to about 2200° F. The carburization step described herein may be repeated any number of times depending upon the depth of carbon penetration desired within the steel. Preferably, the stainless steel alloy is quenched after the vacuum/heating/pulse injection step by lowering the temperature of the furnace and cooling the steel to ambient (room) temperature. The quenched steel alloy is further stabilized in a nitrogen bath at sub-zero temperatures. The quenched steel alloy may be further stabilized by conducting the carburization step in hydrogen or argon to promote uniform diffusion of the nitrogen bath at sub-zero temperatures.

In the case of a martensitic stainless steel, any carburization heat treatment requires a solution anneal at a temperature in the order of about 1040° C. to cause all carbon present in the alloy to be in solid solution, or else sensitization of the alloy occurs, resulting in the embrittlement thereof. When this occurs, nano-sized carbon atoms are rapidly deposited on the surface of the steel and dispersed into solid solution quickly. The carbon is then transported internally by diffusion of the atomic carbon atoms into the interior of the alloy. With respect to martensitic stainless steels, these alloys contain greater than 10% chromium. This chromium provides corrosion protection by formation of a thin, impervious oxide film that adheres to the surface, affording superior corrosion protection. However, chromium is also quite active in the formation of carbides within the grain boundaries resulting in sensitization of the alloy that leads to grain boundary corrosion.

On the other hand, if carbon is introduced to an activated steel surface at these elevated temperatures, it also enters into solid solution rather than in the formation of carbides. Depending on the temperature used to drive the carbon to enter into solid solution, as much as 8.79 m/o carbon can be in solid solution in the iron, without carbide formation. If a fast quench is then provided, the carbon becomes trapped in solid solution. Once stabilized and tempered, a uniform carburized surface results without grain boundary sensitization. In fact, the carburized surface consists of a martensitic foundation homogeneously interspersed with fine carbides, providing optimum wear and corrosion resistance.

In the process of the present invention, carbon from a hydrogen/acetylene gas mixture is deposited onto a stainless steel alloy in a vacuum furnace at partial pressure. This renders all the carbon present in the alloy and deposited at the surface to be in solid solution at a high carbon potential. The stainless steel alloy is first exposed to intermittent bursts of activated dissociated carbon at the surface, and is then placed in a protective atmosphere for longer periods of time to diffuse the deposited carbon into the interior where the gradient of carbon is leaner. As a result, a carburized surface consisting of fine carbides dispersed in a tempered martensitic matrix is possible.

If the stainless steel alloy is quenched quickly, the carbon in solution reacts with the carbide formers (present in their atomic state) and with the matrix iron to form fine carbides within a matrix of martensite. If this is then stabilized in a liquid nitrogen bath followed by an aging treatment to precipitate secondary carbides, a wear resistant surface with improved corrosion resistance is possible. The process produces a surface on the alloy that provides improved wear resistance and corrosion resistance for heavy duty machine components, in particular, arresting gear tail-hook components for naval aircraft. A well-known, commercially available steel alloy, Pyrowear 675®, useful in the practice of the process of the present invention has well established core properties as posted by the manufacturer, Carpenter Technology of Reading, Pa.

The standard carburization process known in the art relies on a clean active surface to receive the dissociated atomic size carbon particles resulting from the dissociation of acetylene or other carbon compounds. The process then relies on Brownian motion for the particles, dispersed in a partial pressure of hydrogen or other gas such as argon, to be transported efficiently to the activated surface of the part requiring a hard wear resistant surface. Once the carbon is deposited on the surface, a diffusion cycle is then required to transport the deposited carbon from the surface into the interior of the part.

The carburization process is dependent on two fundamental equations of state. These include Fick's second law: $D=k\cdot t$. This equation defines the carburization depth and is a function of the temperature selected for carburization and the total time for diffusion to result. The total time for diffusion includes a boost and a diffusion cycle. The second equation of importance is the ratio of the time permitted for the deposition of atomic carbon onto the surface to diffuse ($t_d$) into the alloy as a function of the time allotted for deposition of the atomic carbon on the surface ($t_b$): $R=t_d/t_b$. The remaining factor to consider is the flow rate which is determined as follows:

$$\text{Flow Rate}=C\text{ required}/t_{boost}\times 0.0011\text{ gc/cc acetylene}$$

These fundamentals hold for any material to be carburized. However, martensitic stainless steels, such as Pyrowear 675 contain carbide formers, in particular chromium, which result in a diffusion couple that could cause possible problems in service.

The following examples are provided to more specifically set forth and define the process of the present invention. It is recognized that changes may be made to the specific parameters and ranges disclosed herein and that there are a number of different ways known in the art to change the disclosed variables. Whereas it is understood that only the preferred embodiments of these elements are disclosed herein as set forth in the specification and drawings, the invention should not be so limited and should be construed in terms of the spirit and scope of the claims that follow.

Example 1

For each cycle of carburization which may range from one (1) to nine (9) hours, a 2 inch (5 cm) diameter by 2 inch (5 cm) high steel cylinder was carburized. The initial diffusion temperature was established as 1065° C. This temperature was selected because all the carbon was in solution at this temperature and minimum grain growth will occur. However, it is to be understood that there may be advantages in raising the temperature to expedite diffusion. The acetylene feed into the hydrogen carrier gas was 1.5 cc acetylene using hydrogen as the carrier gas at 8 torr total pressure. This provided a mixture of 18.75% acetylene to 81.25% hydrogen. For this first series of tests to determine the depth of carburization required to obtain a hardness of 58 HRC minimum to a depth of 1 mm, total carburizing time was studied for 1, 2, 3, 4, 6 and 9 hours. An initial boost of acetylene was provided for 5 minutes at a carburization temperature of 1065° C. This was followed by a diffusion cycle of 55 minutes for each hour for the total carburizing time required. After the total carburizing time occurred, the cylinder was quenched to ambient temperature at 10 barr. The cooling rate was of the order of one (1) minute to quench from 1065° C. to 540° C. At this cooling rate it was presumed that all carbon present would be transformed to fine carbides and martensite. Initially, carbon and hardness transverses were made to define the depth of carburization prior to stabilization and aging.

After quenching, chips were machined from the surface inward in 0.1 mm. intervals to determine the carbon profile after carburization. These profiles are included as FIG. 1. The stainless steel cylinder initially has a carbon concentration of about 2 m/o at the surface, which diminishes as it is diffused inwardly as a function of time. After a nine (9) hour carburization cycle, the carbon concentration is 0.8 m/o at a distance 1 mm. from the surface, satisfying the requirement for minimum hardness of 58 HRC.

Figure 2:
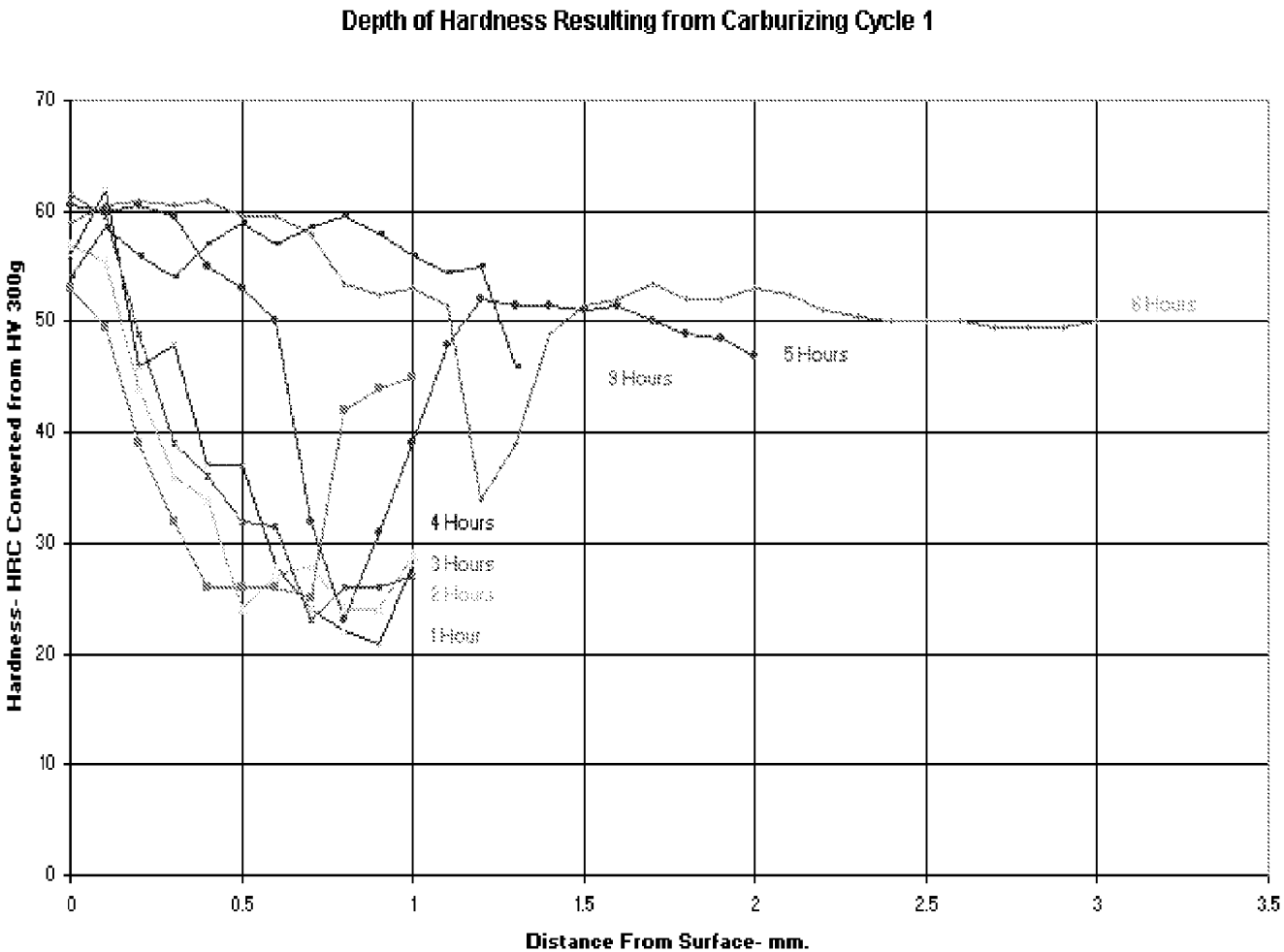
FIG. 2 shows a number of different hardness depth profiles of the carbon content of steel carburized for the different time periods shown in FIG. 1.
Figure 3:
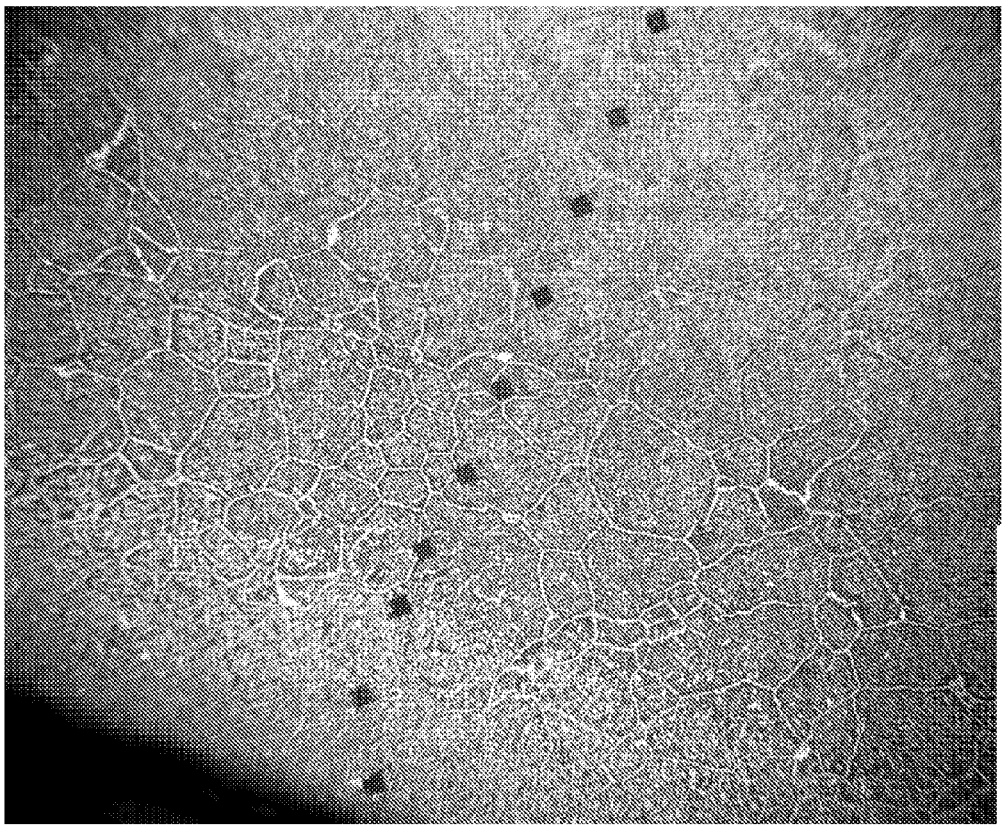
FIG. 3 shows pictures of the microstructure of stainless steel carburized for nine (9) hours at 1000° C. in acetylene gas at 8 torr pressure.
Figure 3A:
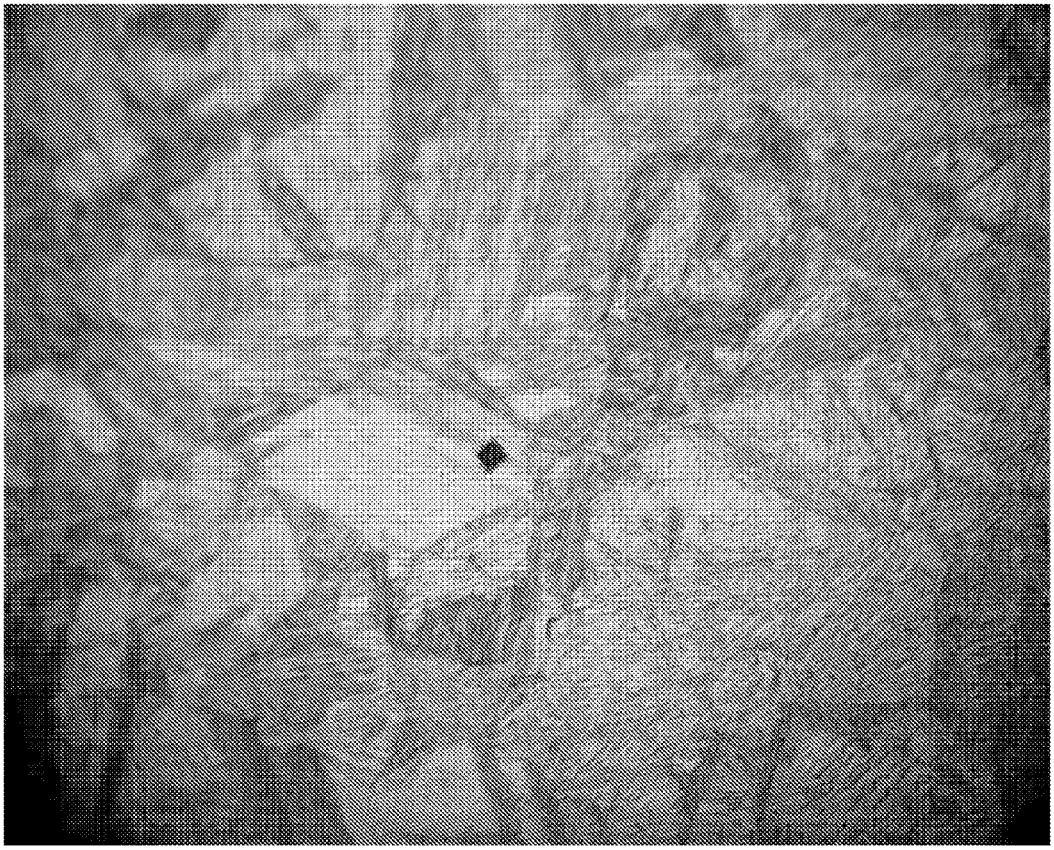

A similar traverse showing the hardness profile is included as FIG. 2. The profile also shows that a hardness≧58 HRC extends for a distance of 0.7 mm from the surface inward. However, in all cases, regardless of carburization time, there is a precipitous fall-off in hardness followed by a recovery to some level of hardness, eventually reaching the level of the core hardness of 44 HRC. The microstructure of the surface and the core is included as FIG. 3. For a distance of approximately 0.2 mm there is no evidence of microstructure other than fine (what is believed to be) carbides that exists for an additional 0.2 mm. into the surface. From that distance further into the core grain growth is prevalent with clear evidence of carbide transport through grain boundary diffusion. This is a non-stabilized carburized surface.

Figure 4:
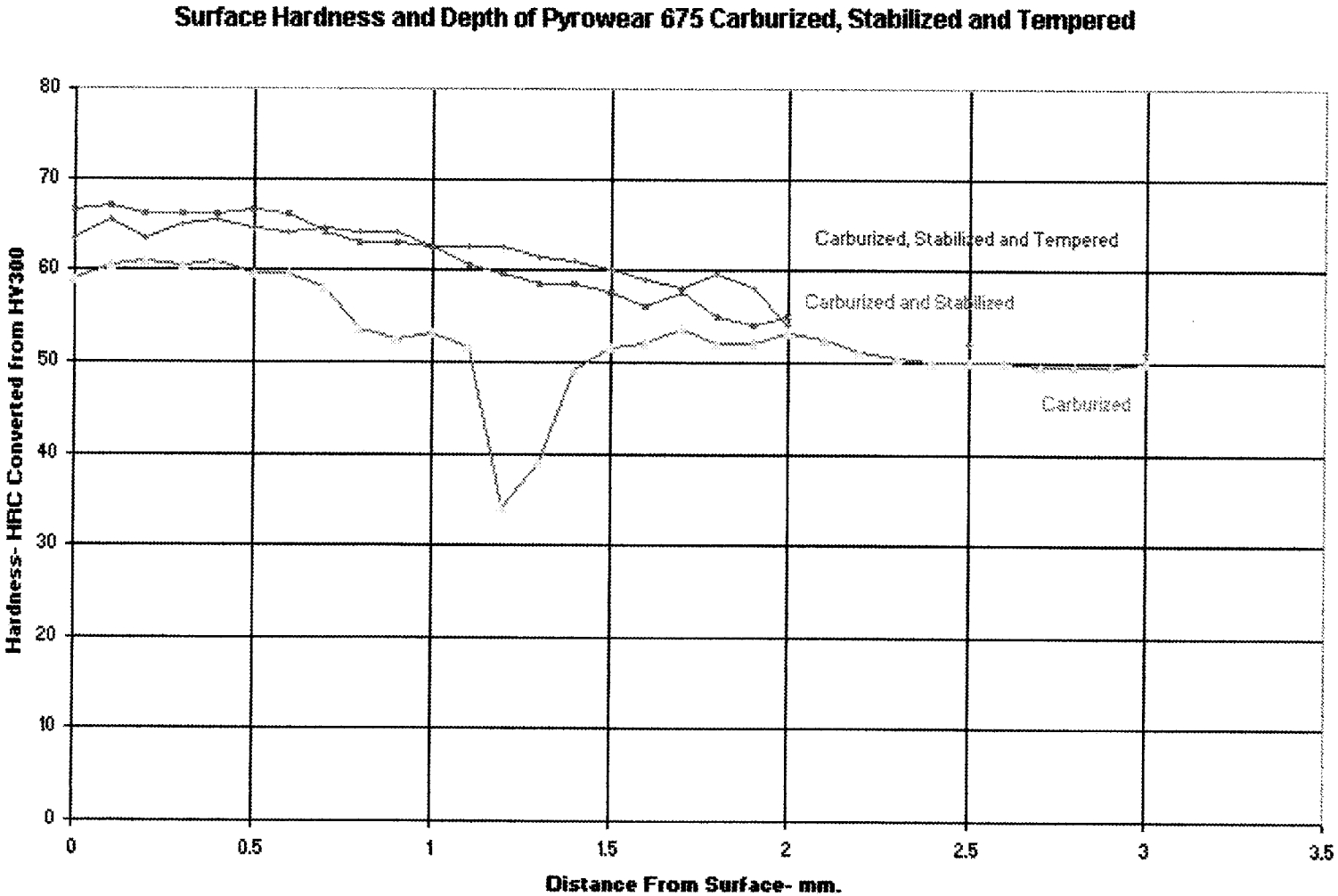
FIG. 4 shows a number of different surface hardness carbon depth profiles of the carbon content of steel carburized for the different time periods shown in FIG. 1.

Since the carburized material had not been stabilized at this point, the stainless steel was a stabilized in liquid nitrogen at −185° C. for 30 minutes, followed by aging at 510° C. for four (4) hours. Again, a hardness traverse was made to determine the depth of hardness of the carburized surface after these additional steps to the heat treatment were made. FIG. 4 shows a hardness traverse comparing the billet in the various stages of heat treatment. It is clear that the stabilization treatment of −185° C. succeeded in stabilizing the carburized surface, resulting in a traverse of 60 HRC or greater to a depth of 1.5 mm and a further hardness of >55 HRC to a depth of 2 mm.

Figure 5:
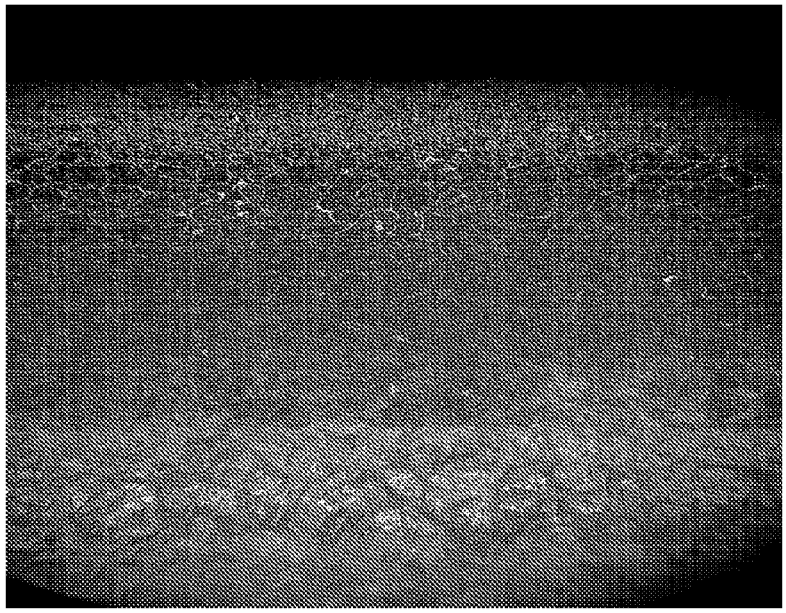
FIG. 5 shows the microstructure that resulted from the additional stabilization and aging cycle
Figure 5:
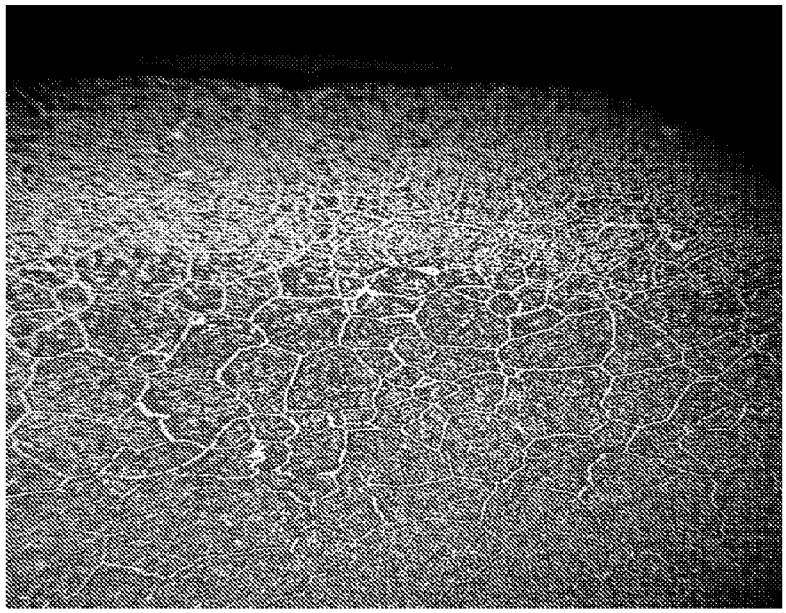

FIG. 5 shows the microstructure that resulted from the additional stabilization and aging cycle. Notice that the carburized surface actually consists of possibly six distinct layers. These layers are visible at low magnification as observed in FIG. 5. Examples of the microstructure within these strata are also included at higher magnification. The first micrograph shows the structure of the surface. It consists of carbides concentrated within grain boundaries with additional carbides homogeneously distributed within the grain in a martensitic matrix. The second layer from the surface consists of larger grains with carbides distributed within the grains in a higher concentration of martensite. The third layer shows the same microstructure but within coarser grains. The fourth layer shows a transition where less finer carbides appear to be dispersed in martensite with faint evidence of grain boundaries. The fifth layer shows more of the same whereas the sixth layer begins a transition to the lath martensite characteristic of the core. This is the characteristic microstructure and hardness profile expected.

Figure 6:
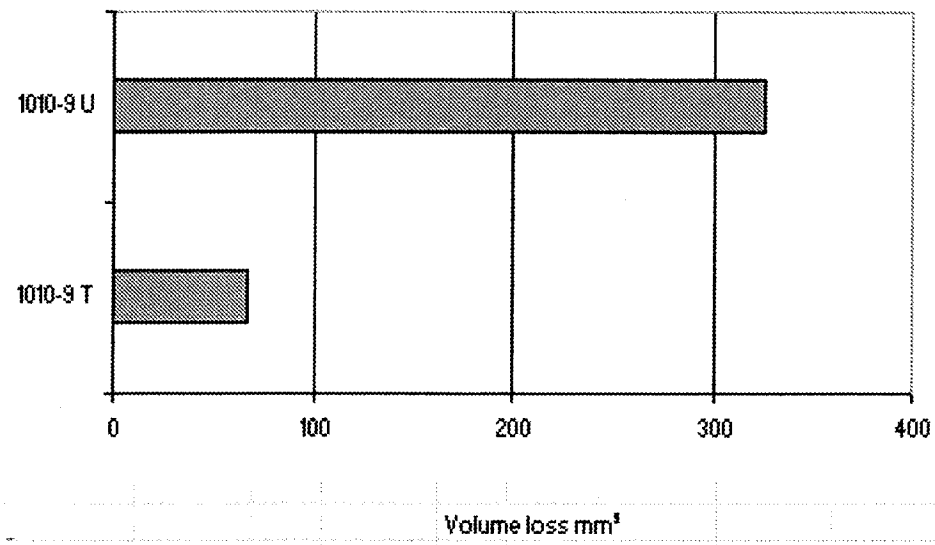
FIG. 6 shows the comparison of the carbon profile of the two inch (5 cm billet with the 5 inch (12.7 cm) billet.

FIG. 6 shows the comparison of the carbon profile of the two inch (5 cm billet with the 5 inch (12.7 cm) billet. Even though this billet was carburized, quenched, stabilized and aged, the hardness profile did not exhibit the same improved hardness profile as that of the two inch billet, receiving identical heat treatment. However, it did appear as if the billet had not been stabilized and aged, merely carburized and tempered.

Example 2

The stainless steel was carburized under a boost of acetylene of 1.5 cc at 8 torr pressure in hydrogen for five minutes boost time followed by a diffusion time of 55 minutes for eight cycles (eight hours total carburizing time) at 1065° C., stabilized at −185° C. and aged at 510° C. for four (4) hours to determine the steel alloys' performance properties. This cycle was used because it provided a carburization hardness and depth consistent to what was expected. A five (5) inch diameter billet was carburized, 10 barr quenched, stabilized and aged according to this process.

Fracture Abrasion Test

An abrasion test was made to determine the carburized steels resistance to abrasion by abrading the surface with dry sander material mated with a revolving rubber wheel according to ASTM Specification G65, Procedure A (5). The machine used was a Falex ATM S/N AT-88-019. The operating conditions were 200 r.p.m. with a 30 pound force for 2000 revolutions. The media for abrasion was AFS 50-70 and the flow rate was 340 g/min. Pyrowear 675® is noted for its' resistance to scuffing and corrosion. Two specimens were tested; one that was carburized using the procedure described above and is designated as sample A. The other specimen was not carburized, but had received the same thermal treatment. This specimen was designated sample B.

Prior to testing, the samples were weighed and after sanding they were again weighed to determine the mass loss and ultimately the volume loss. Correspondingly, the wheel loss was measured and its volume loss determined. (see FIG. 6). If the protection afforded the Pyrowear® 675 surface is compared with the carburized surface, it can be observed that a loss of only 3.9 m/o occurred, compared with the weight loss of the non-carburized surface. Also, if the samples are compared to the surface hardness of other protective coatings, such as from self-fluxing hard faced nickel or cobalt base alloys, the surface is comparable, if not superior in wear resistance. Therefore, the carburization cycle employed will provide a wear resistant surface at lower cost with no detriment to the environment.

Figure 7:
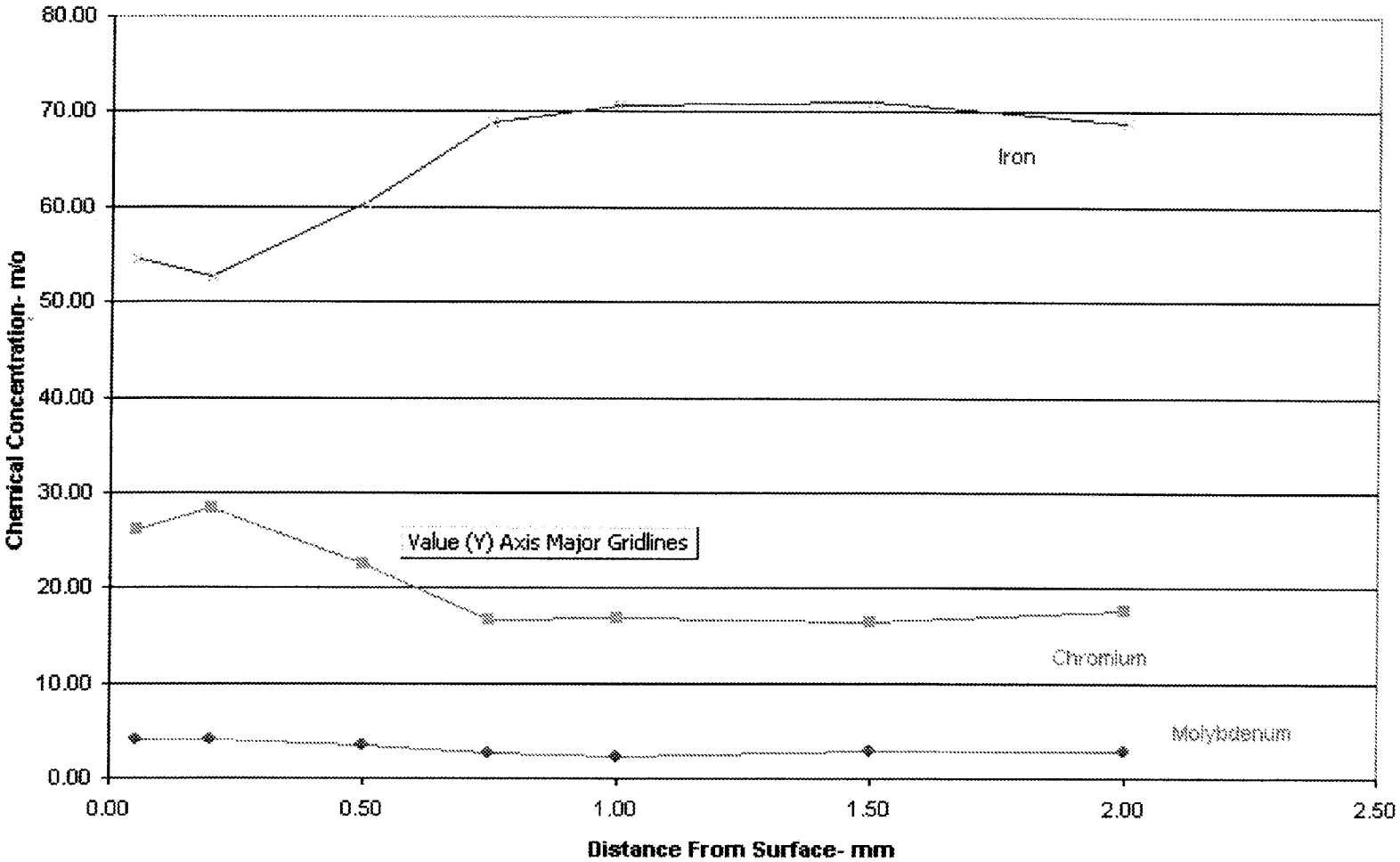
FIG. 7 is a graph comparing the amount of carbon deposited in the samples of the carburized surface with the uncarburized surface.
Figure 10:
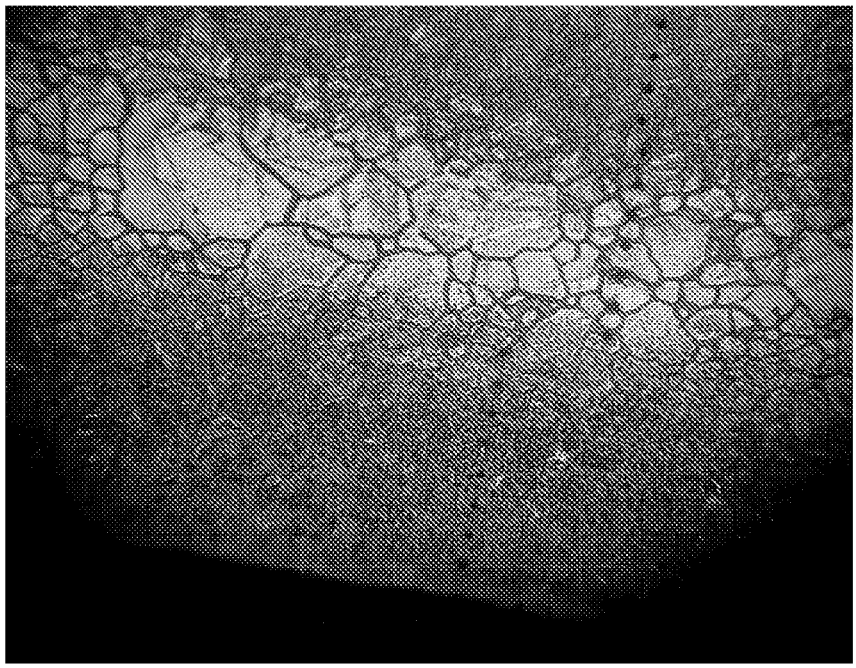
FIG. 10 is a micrograph that shows the surface of the 5 inch diameter billet that was carburized.
Figure 10:
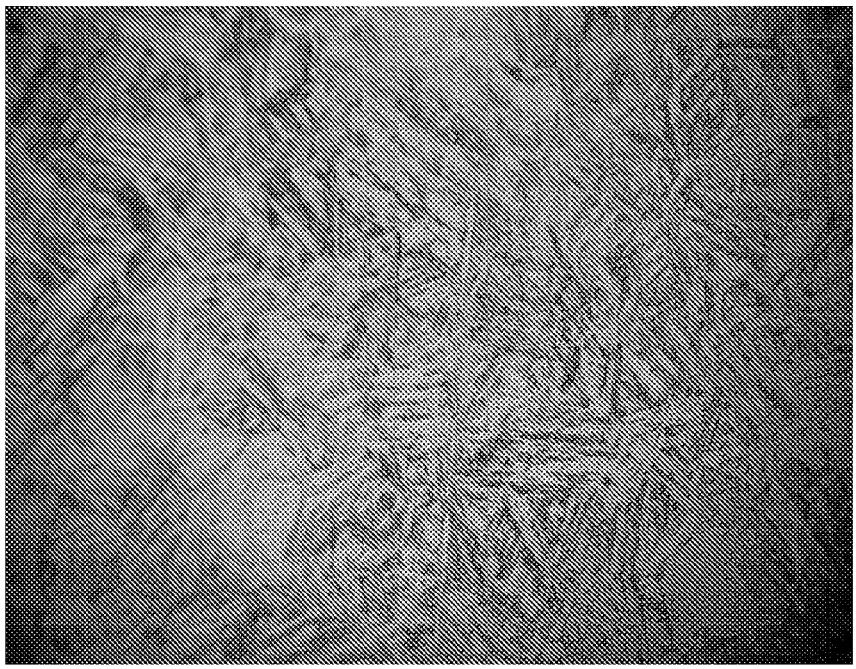

FIG. 7 shows the variation in the type of carbide formers within the stainless steel surface of the 5 inch diameter billet that was carburized. FIG. 10 shows the surface of the 5 inch diameter billet that was carburized. Again, the region of large grain growth is evident below the strata of the carburized surface. In contrast, a micrograph of the martensite core is included for comparison. All this corresponds with the previous data that was included for the 2 inch billet, prior to stabilization and aging.

A characterization of the chemistry composing the strata was in order. The surface of the two inch billet that was carburized, 10 barr quenched, stabilized and aged was selected for this analysis. Spectra was characterized and mapped using the EDAX unit of a scanning electron microscope. Spectra were obtained at the different levels of the carburized surface, where distinct changes in strata were observed in the optical microscope. The chemistry of the elements of interest is included as Table I. Carbon is not included because the true values of carbon are shown as a function of depth from the surface. This data is available in FIG. 1. Carbon data obtained from SEM spectra is often inaccurate because of contamination within the environment of the SEM. However, it is clear that there is close to 2 m/o carbon at the surface and this amount diminishes until the level of carbon is 0.8 m/o 1 mm into the interior. The principle carbide formers are compared with iron and their base compositions of the core in FIG. 8. The chromium composition of the core is 15.70 m/o, that of the molybdenum 1.80 m/o and that of the iron 82.64 m/o.

TABLE I

Chemical Analysis of Strata Detected in Surface Strata of Carburized. 10 Barr Quenched, Stabilized and Aged Two Inch Billet

| Distance From Surface-mm | Chromium-m/o | Iron-m/o | Molybdenum-m/o |
|---|---|---|---|
| 0.05 | 26.19 | 54.55 | 4.03 |
| 0.20 | 28.30 | 52.64 | 4.13 |
| 0.50 | 22.47 | 60.31 | 3.42 |
| 0.75 | 16.59 | 68.93 | 2.57 |
| 1.00 | 16.74 | 70.77 | 2.3 |
| 1.50 | 16.39 | 71.14 | 2.75 |
| 2.00 | 17.62 | 68.78 | 2.9 |
| core | 15.70 | 82.64 | 1.8 |

It is evident that a classical diffusion couple is in operation. There is an abundant supply of carbon at the surface and both the chromium and the molybdenum are most stable as carbides. Therefore, the atoms of these species migrate toward the surface and being more aggressive than iron, react to form the most stable carbide, or carbides, depending on the available concentration of carbon. What remains is then available for martensite formation. The surface strata become uniformly concentrated with chromium, molybdenum and iron. Note that chromium, molybdenum and vanadium, the carbide formers, are much more concentrated at the surface than in the core. However, the concentrations appear uniform within the microstructure and there is little evidence of grain boundaries.

Although the mechanism for formation of the carburized surface is now apparent, there was insufficient time to make the same scan on the five inch diameter billet surface. Since the excess carbide formers had to come from some source, without being bound to any theory it is postulated that the source is the region where grain growth and chromium, molybdenum and vanadium appear to be depleted, leaving a strata which is lower in hardness than the core. This may be ferritic, rather than martensitic.

Figure 8:
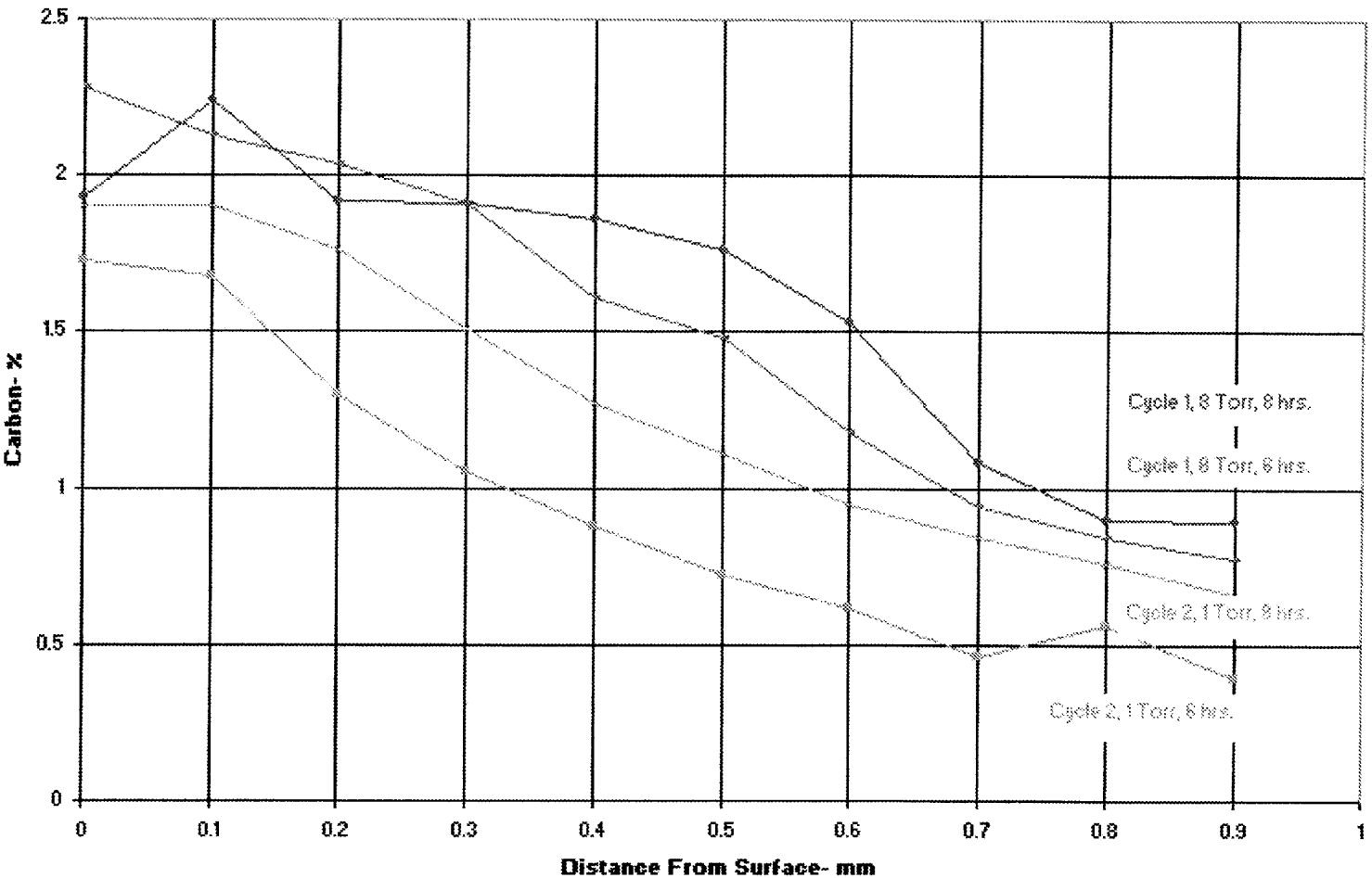
FIG. 8 shows a number of different surface hardness carbon depth profiles and the amount of carbon deposited after cycles 1 and 2.

FIG. 8 compares the carbon distribution resulting from the reduced boost cycle used to limit the carbon supply at the surface with the cycle that has been described previously. Indeed, there was a reduction; however, the diffusion rate was the same.

Figure 9:
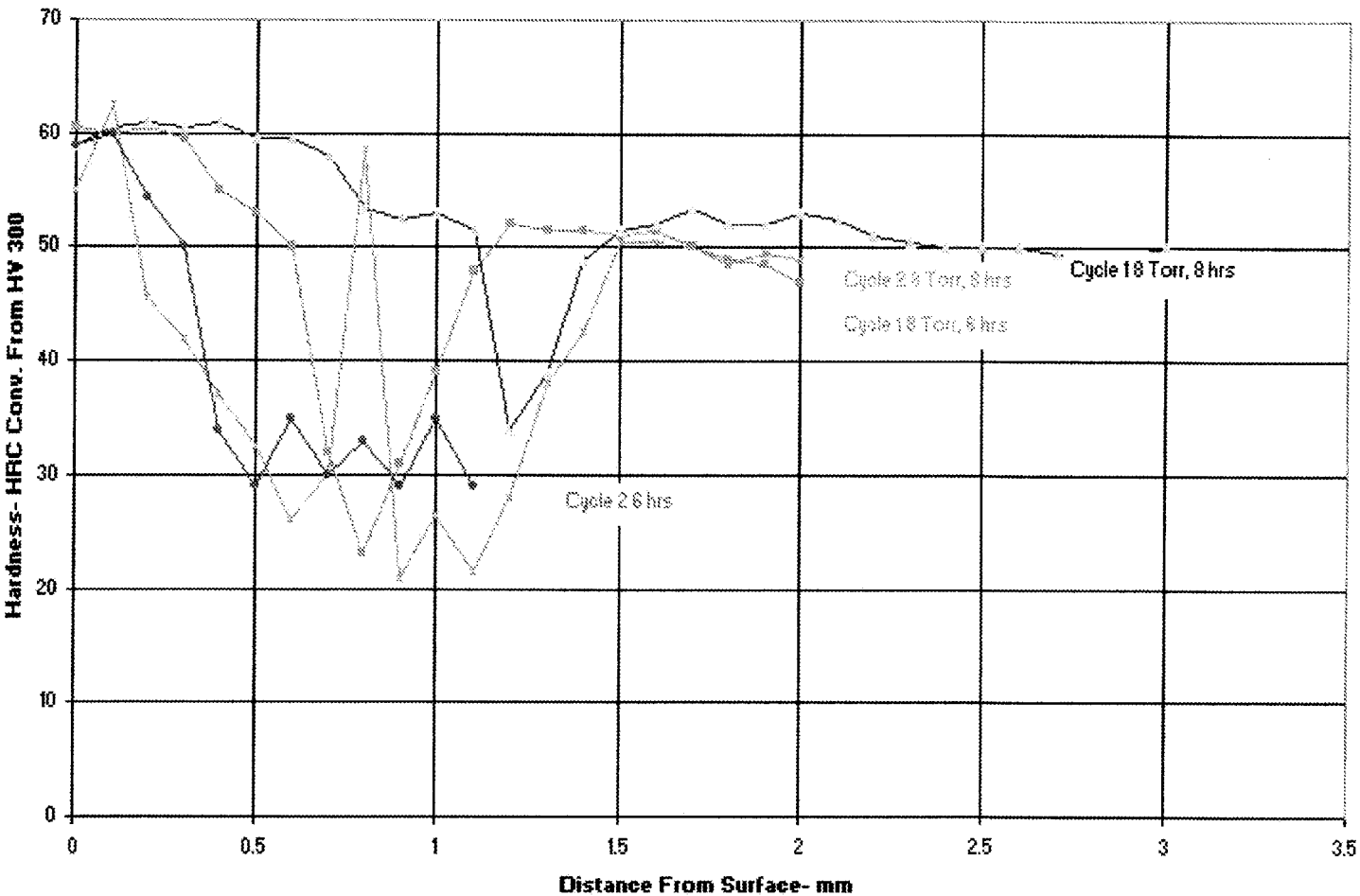
FIG. 9 is a graphic representation of the different surface hardness carbon depth profiles and the amount of carbon deposited after cycles 1 and 2.

FIG. 9 compares the same hardness profiles of the specimens carburized using the two different cycles. It is readily apparent that the larger acetylene concentration, coupled with time of eight hours yields the most uniform carburized surface. However, the length of the diffusion cycle remains as the controlling factor.

The carburization process of the present invention then, can produce a carburized surface two (2) mm deep in less than ten (10) hours as compared with current carburization processes that require more than twenty-four (24) hours to produce the same carburized surface depth of 0.2 mm. Deposition of carbon on the surface is at a higher concentration of approximately 1.8 to 2.0 m/o carbon because carbon solubility in austenite is higher at temperatures greater than 1065° C. Diffusion of carbon deposited on the surface is more rapid because the diffusion rate is faster at higher carburization temperatures. The process is more economical because furnace time and the resulting energy costs are much lower. The process consists of a boost cycle of short duration followed by a diffusion process of longer duration. Several boost and diffusion cycles are required, depending upon the depth of hardness desired.

A further diffusion time may be required to overcome the diffusion couple where chromium is depleted from an interior strata interfacing with the core martensite. For minimal grain growth, the carburization temperature should be of the order of (1065° C.). A diffusion couple occurs where chromium and other carbide formers are transported toward the abundant supply of carbon at the surface, creating a chromium carbide rich surface that results in exceptional wear resistance and minimal surface corrosion.

The process also requires a stabilization treatment at sub-zero temperature to stabilize the martensite and eliminate retained austenite. Tempering has been designed to age the alloy to create secondary carbides and appears to need less time, owing to the stabilization treatment. The carburized strata, which are seven or eight distinguished regions, consist of different carbides and increasing martensite formation comprises the carburized surface. The immediate surface is chromium carbide rich and the amounts and probably the kind of carbides decrease from the surface strata inward to the core. In contrast, the martensite formation is least at the surface, because the chromium carbide formation predominates. The most interior formation appears to consist of carbides concentrated within large grains and an internal grain microstructure still requiring definition.

The core hardness and the core properties of tensile strength and impact strength are similar to those commercially available, but require less time and expensive heat treatments to attain these properties, resulting in further cost savings in money, energy and degradation of the environment. The fracture toughness measured was much lower than that previously reported. Further additional heat treatment may be required to improve this property. By carburizing the surface, a wear test indicates that the resistance to wear caused by abrasion of sand on the surface under load with a rotating hard rubber wheel for 2000 rotations of the wheel (Falex test) results in 80% improvement regarding abrasive wear.

Although the surface appears to be rusted within 24 hours, the condition appears to be mostly visual, with no evidence of pitting and less than 1 m/o weight loss in 2000 hours. The carburizing process appears to improve wear resistance, with minimal corrosion and equivalent core properties at lower cost, less total heat treatment time, lower energy consumption and is friendlier to the environment.

What is claimed is:

1. A process for carburizing martinsitic stainless steel in a high temperature furnace comprising:

i. reducing the pressure in the furnace by removing the air therein to create a partial vacuum at a furnace atmospheric pressure of from about 300 torr to about 500 torr;

ii. contacting said steel with a hydrocarbon carburizing gas mixture consisting of acetylene and hydrogen through the intermittent pulsed injection of the gas that replaces the air removed in the pressure reduction step at a temperature of from about 1800° F. to about 2500° F.;

iii. contacting said steel with the hydrocarbon carburizing gas for a period that allows the carbon to dissociate from the gas mixture and deposit on the surface of the steel to a specified depth of penetration; and, iv. quenching the steel by rapidly reducing the temperature from about 1100° C. to about 500° C. at increased pressure of about 10 barr to produce a substantially hardened martinsitic base.

2. The process of claim 1 wherein the temperature within the furnace is raised in a partial pressure of hydrogen to remove any residual oxygen or other contamination from the surface of the steel.

3. The process as recited in claim 2 wherein said steel is hardened on its surface.

4. The process as recited in claim 3 wherein said acetylene/hydrogen mixture is in a ratio of from about 1:1 to about 1:10.

5. The process as recited in claim 4 wherein said acetylene/hydrogen mixture is in a ratio of from about 1:9.

6. The process as recited in claim 5 wherein said gas is introduced through an intermittent pulsed injection into a furnace atmospheric pressure of from about 300 torr to about 500 torr.

7. The process as recited in claim 6 wherein said quenched steel alloy is further stabilized in a nitrogen bath at sub-zero temperatures.

8. The process as recited in claim 7 wherein said quenched steel alloy is further stabilized in hydrogen and argon to promote uniform diffusion of the nitrogen bath throughout the alloy at sub-zero temperatures.

* * * * *